US009694274B2

(12) United States Patent
McCary, Sr.

(10) Patent No.: US 9,694,274 B2
(45) Date of Patent: Jul. 4, 2017

(54) ELECTRONIC MATCHING BOARD GAME

(71) Applicant: John Milner McCary, Sr., Birmingham, AL (US)

(72) Inventor: John Milner McCary, Sr., Birmingham, AL (US)

( * ) Notice: Subject to any disclaimer, the term of this patent is extended or adjusted under 35 U.S.C. 154(b) by 581 days.

(21) Appl. No.: 13/999,288

(22) Filed: Feb. 7, 2014

(65) Prior Publication Data

US 2015/0224390 A1 Aug. 13, 2015

(51) Int. Cl.

| | |
|---|---|
| ***A63F 1/04*** | (2006.01) |
| ***A63F 3/00*** | (2006.01) |
| ***A63F 1/18*** | (2006.01) |

(52) U.S. Cl.

CPC ..... *A63F 3/00643* (2013.01); *A63F 1/04* (2013.01); *A63F 1/18* (2013.01); *A63F 2003/00662* (2013.01)

(58) Field of Classification Search

None

See application file for complete search history.

(56) References Cited

U.S. PATENT DOCUMENTS 2,521,775 A * 9/1950 Brower ..... A63F 9/0098 273/272
3,994,499 A * 11/1976 Barlow ..... A63F 3/0478 273/256
5,120,065 A * 6/1992 Driscoll ..... A63F 3/00643 273/237
5,601,288 A * 2/1997 White ..... A63F 3/00 273/271
6,102,397 A * 8/2000 Lee ..... A63F 3/00643 273/238
6,325,374 B1 * 12/2001 Burger ..... A63F 3/00 273/236
6,835,131 B1 * 12/2004 White ..... A63F 3/00643 273/237
7,008,316 B1 * 3/2006 Pugh ..... A63F 3/0421 273/236
7,798,495 B1 * 9/2010 Jolicoeur ..... A63F 7/0652 273/237
2004/0248650 A1 * 12/2004 Colbert ..... A63F 3/00643 463/37
2005/0137004 A1 * 6/2005 Wood ..... A63F 3/00643 463/11

(Continued)

FOREIGN PATENT DOCUMENTS

GB 2162432 A * 2/1988 ..... A63F 3/00

*Primary Examiner* — Tramar Harper

(57) ABSTRACT

The present invention is a card matching electronic board game with the object each individual player matching cards. Each player gets passed cards and can either accept or pass the card which must then be swiped in the player's station card swipe and then passes the card. If a player is too slow swiping light and sounds are activated at the player's station. A player who has the number of matching cards can then press a lighted press button. The electronic game board controller determines the number and location of active lighted press buttons needed, usually one less than the number of active players. The last player attempting to press a lit press button is the looser of the session with a predetermined number of losses decide when a player is out of the game. The last person not out of the game is determined the winner of the game.

5 Claims, 4 Drawing Sheets

(56) References Cited

U.S. PATENT DOCUMENTS

Figure 1:
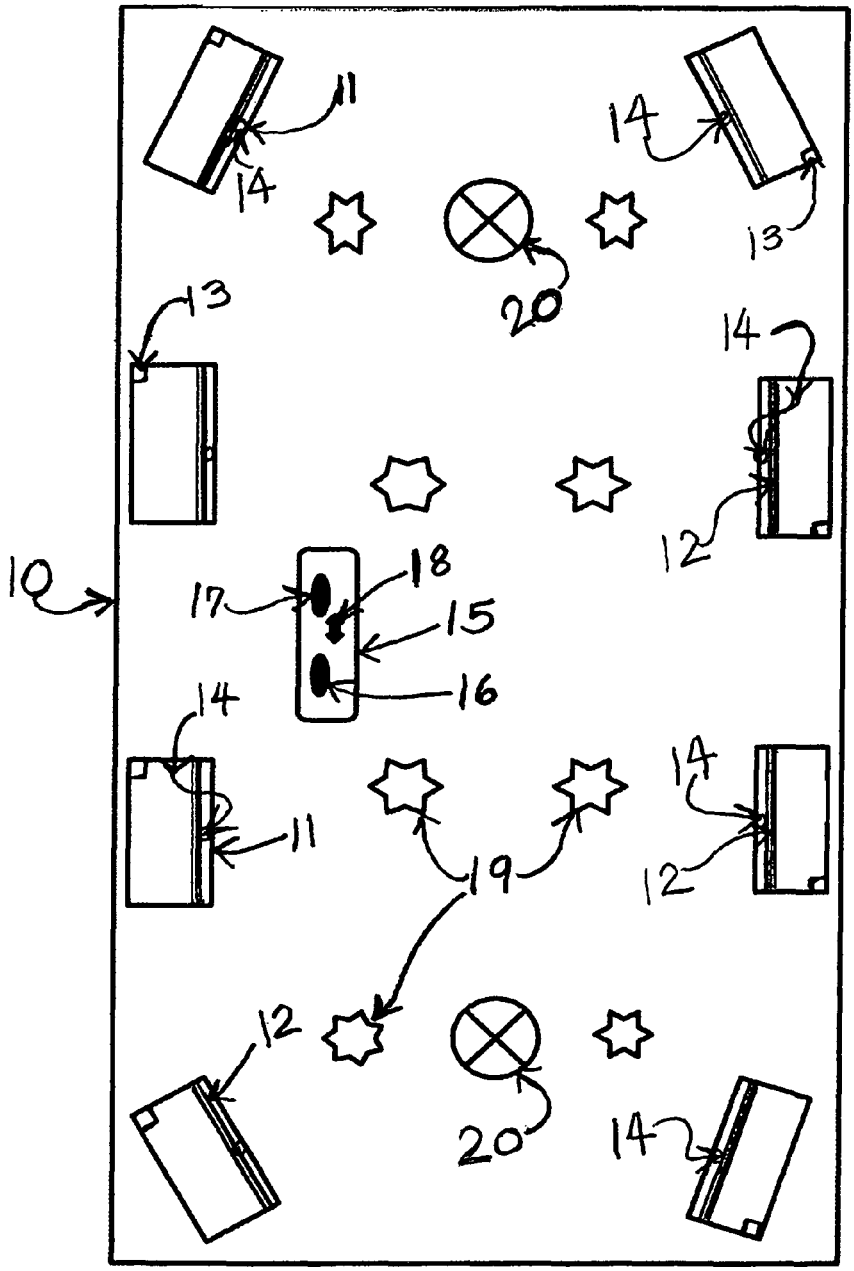

2006/0175753 A1* 8/2006 MacIver ..... A63F 3/00643
273/237
2006/0287053 A1* 12/2006 Yokota ..... A63F 5/00
463/17

* cited by examiner

ELECTRONIC MATCHING BOARD GAME

FIELD OF THE INVENTION

The present invention relates to a matching card game being played on a game board with electronic circuits and electronic devices.

BACKGROUND OF THE INVENTION

Over the years board game developers have attempted to integrate electronics into board game play, using electronics to try and enhance the game's marketability. In order to offer the electronic board games at prices that are attractive to consumers the electronic board games developers have had to be inventive in using a limited amount of expensive electronics while trying to develop new excitement to an existing or new board game.

Non-electrical matching card games such as "Go Fish", "Pig" and other popular family matching card games where one draws or is passed a card trying to obtain the correct number of face card matches or sets, have been enjoyed for many years. In most of these non-electrified games there have been limited additions of sounds, music, lights or other electrical devices that may add enhanced excitement to these traditional matching or set achieving games.

SUMMARY OF THE INVENTION

The present invention is a card matching or set achieving electric board game where electronics are used to add excitement to existing time proven player enjoyment activities of the game. The electronic board game usually has eight player stations spaced apart and placed on the periphery of the game board. At each station is a card "swiping slot" that is tied to an electronic circuit, a "player" button next to the swiping slot that is tied to the electronic circuit and a set of lights, usually two to three, and small sound buzzer that is placed next to the card swiping slot and is also on the electrical circuit. The electrical circuit of each player station is tied into the game controller circuit board placed on the board. The game controller is also connected by circuits to a set of press buttons specifically place at various spaced out points near the center of the game board between the player stations. One or more speakers would be placed on the board game which would also connect to the game controller. An AC and/or DC power supply would connect to and provide electrical power to the electronic game board.

The basic game and function of the electronic components would proceed first with the type of matching game and level of play selected. Each basic game would start with approximately 80 to 104 cards. The card category may be for example animals, fruits and vegetables, shapes with colors and or playing cards (one through king/aces). The dealer position, or person who deals out the cards, would usually start at one player station on the board and the move to the left player station player to be the next dealer on the following dealing of card hands. The dealer would usually deal out 4 shuffled cards to each player playing at an individual station. Once the 4 cards are dealt out the "reset" or "on/off" button is pressed to notify the game controller that a new game session is starting. The game controller has preloaded sounds and/or music, or outside music or sounds can be connected to the game controller. The music and/or sounds can start playing at this time to get the players excited and ready to play, and each player presses the "player" button at each player's station that notifies electrically the game controller the number and location of the active player's stations. The game controller "start" play button is then pressed to notify the control system that play is beginning. Actual play begins with the dealer then draws an individual card from the face down game card stack and then the dealer looks at the drawn card face. If the dealer wants the drawn card then the dealer takes the card and places the drawn card into his hand and then one card for the dealer's hand has to be discarded, or no longer wants in the hand, and the discarded card is then swiped through the dealers player station card swipe.

The discarded swiped card is then placed face down next to the closest player to the dealers left. If the dealer does not want to place the drawn card into his hand the dealer then swipes the drawn card and then places the swiped card face down to his left to the closest player. The next player to the dealers left can the pick up the dealer placed card and place in the players hand or the player can swipe the drawn card and then pass the drawn card to the next player to the left. This procedure of drawing, swiping and passing continues to the last player to the left who the takes the players swiped card and starts a new face down stack.

The card swipe slot is angled so that the swiped card's top edge is slanted outward away from the player. As each passed card from is picked up by either the player's right or left hand the player will usually draw the picked up card toward the player. Some players have a tendency to get excited and not even want to look at their cards as they are passed from the right and may want to just take the card and quickly passed the drawn card to the left while just looking primarily to the center of the board to see if any of the lit press buttons have been pressed. By the player having to swipe the card the process pulls the attention of the player to the swiping procedure plus the angle of the card in the card swipe in most instances exposes the face of the card to the player, further drawing the player's attention that the drawn card may be a match to other cards in the player's hand.

The object of the game is usually to match or obtain a number of faced cards. An example may be for a particular game where there are 80 cards that have 10 different vegetables on the face of the cards, meaning that there would be 8 matching cards in the game stack or deck for each vegetable. As each player gets drawn cards the player is trying to get 4 of the same vegetable faced card in the player's hand, each player only suppose to keep 4 cards in each player's hand. The game controller, knowing the number and location of each player, determines the number of active lighted press buttons needed in the near center of the game board. The number of active lighted press buttons is usually one less than the number of active players. The lighted press buttons location and movement is determined by the location of the active player as determined by each active player pressing the "player" button before each session of a game. In this game example if a player is too slow in passing a swiped card one or more lights start flashing at the slow passing player's station. If the slow passing player continues to be slow a sound, possibly a buzzer, is activated further notifying the slow player who may be getting "razzed" at this time by the other players and the slow player may be disqualified from playing this sequence and the slow disqualified player or a session exiting player presses it's "player" button, notifying the game controller that the player has exited the game and the game controller will reduce lighted pressing buttons by one, and the game session can continue with the remaining players.

When a player gets 4 of a matched kind, or whatever number or sequence previously decided for the game session, the matching player then quietly, stealthily reaches out and presses one of the lit press buttons. The matching player and other players that have pressed the lighted press buttons may continue to swipe and pass cards waiting to see if other players will notice if press buttons have been pressed. The last player left who has not pressed a lit press button is the looser of that particular session of the game. A predetermined number of losses decide when a player is out of the game. The last person not out of the game is determined the winner of the game.

If a player is the first player to touch a lighted press button and does not have the 4 of a matched kind, or whatever matching number or sequence has been previously decided for the game session, the player is disqualified from the game session and the disqualified player presses the "player" button which notifies the game controller that the player has been disqualified or the player is no longer an active player in the game session and one less lighted press button will be available to be presses if the player, and the game session can continue with the remaining players.

The card matching electronic game board is designed to be folded up into approximately one half the size of the full game board. Additional electronic devices can be added to the board game as costs and market acceptance allows. Mp3 music, DVD music or other sounds can be down loaded or added into the electronic board game system.

BRIEF DESCRIPTION OF THE INVENTION

FIG. 1, in an overhead view, shows the base layout of the electronic matching board game.

Figure 2:
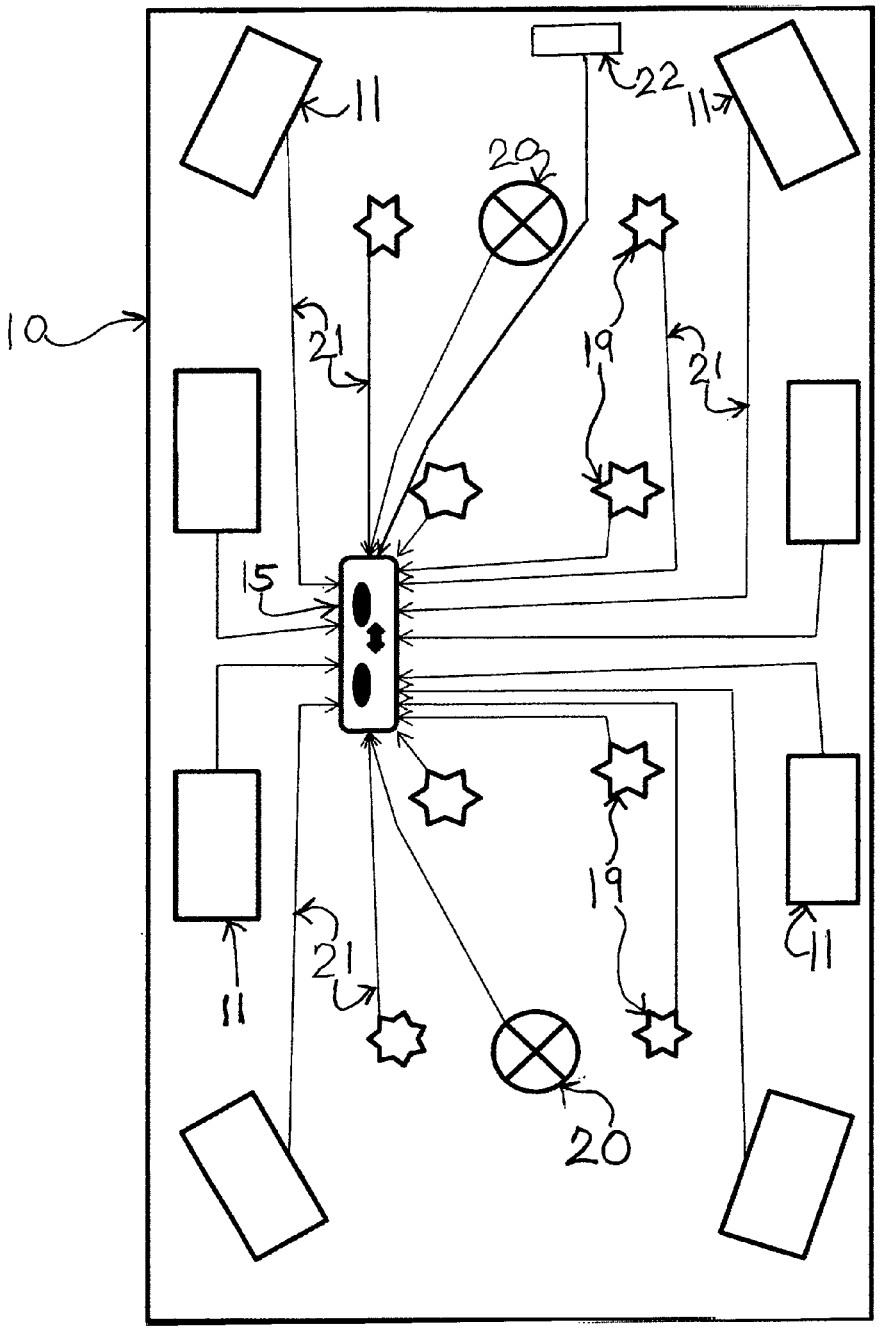

FIG. 2, in an overhead view, shows the base circuits and game controller of the electronic matching game board.

Figure 3:
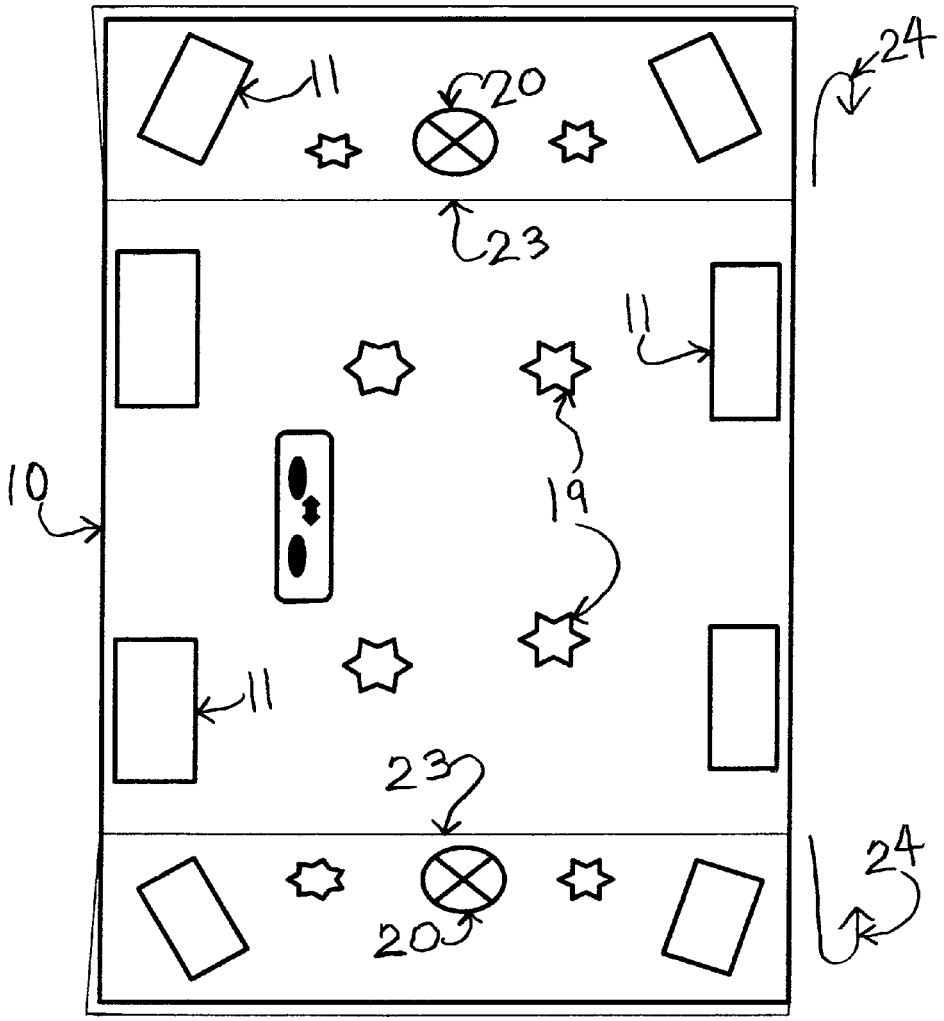

Shown in an overhead perspective view, FIG. 3 shows how the electric game board can be folded up.

Figure 4:
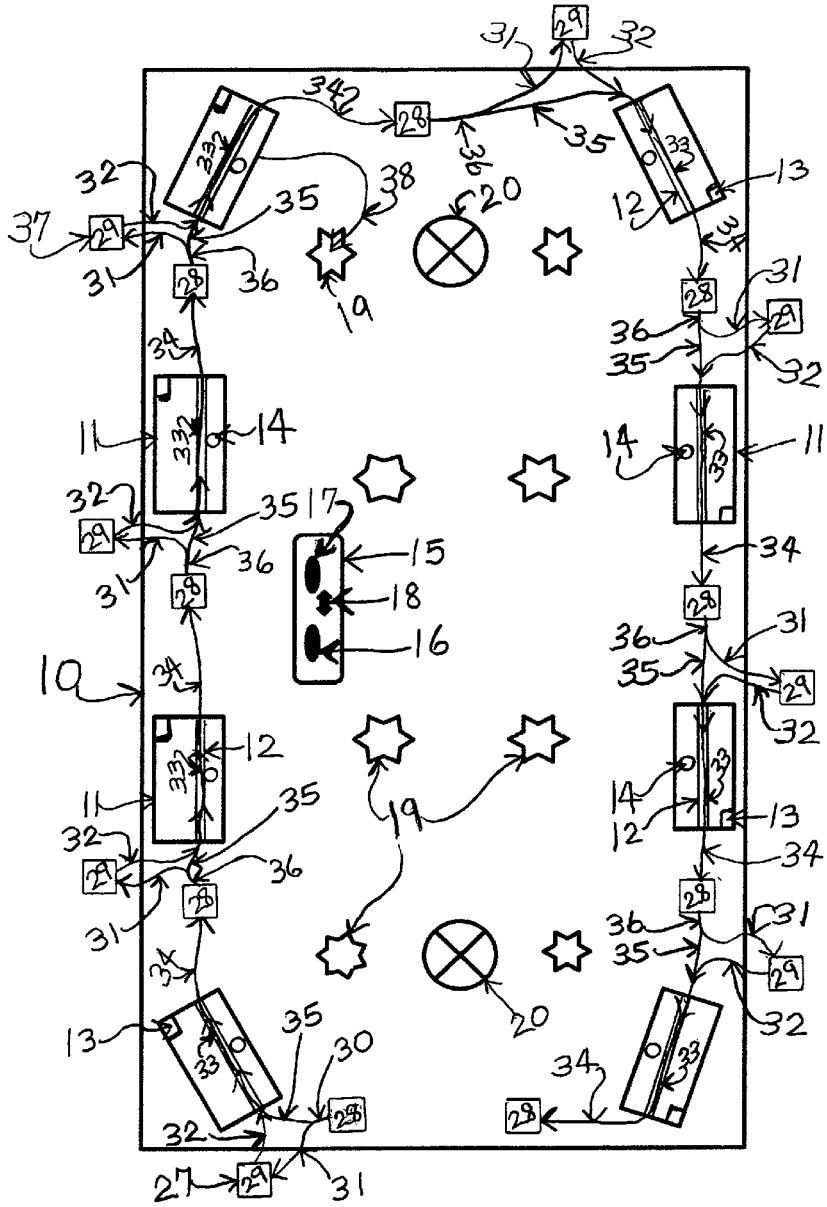

FIG. 4, in an overhead view, shows a game play method of the game platform of a passing card game.

DETAILED DESCRIPTION OF THE INVENTION

FIG. 1, in an overhead view, shows the game board 10 with the individual player stations 11. The player stations are shown with the card swipe slot 12, "player" button 13, light and sound section 14. The game controller circuit board 15 is shown with "reset/on/off" button 16, "start/stop" button 17 and the music and/or sound controller 18. Shown are the light-able press buttons 19 and speakers 20.

FIG. 2, in an overhead view, shows the electrical and data circuits 21 connected from the individual player stations 11, the light-able press buttons 19 and speakers 20 to the game controller circuit board 15 on the game board 10. The AC and/or DC power supply 22 is also shown connected to the game board controller.

Shown in an overhead perspective view FIG. 3 is the electronic game board 10 with player stations 11, game circuit controller 15, press buttons 19 and speakers 20. Shown also are the folding lines 23 where the game board can be folded up 24.

FIG. 4, in an overhead view, shows a game play method of the game platform of an interactive passing card game. Shown is the game board 10 with the individual player stations 11. The player stations are shown with the card swipe slot 12, player activation "player" button 13. The game controller circuit board 15 is shown on the game board 10 with "reset/on/off" button 16, "start/stop" button 17, the music and/or sound controller 18. Shown are the press buttons 19 and speakers 20 also on the game board 10. A game session of a game may start with the game controller circuit board "reset/on/off" button 16 turned to the "on" position. Each active game player at a player station 11 would activate their player station "player" button 13. A "Dealer" 27, who has been chosen by the rules of the particular game being played, has a stack of game cards 28, of the particular game being played, stacked next to the Dealer. The Dealer deals from the stack of game cards 28 a set number of game cards to each active player, including to the Dealer who is an active player, each active player then having a player hand 29 of game cards 28. The game controller circuit board "start/stop" button 17 is activated to the "start" position. The Dealer then draws one or more card(s) 30, from the remaining stack of game cards 28 and then the Dealer either places the drawn card(s) 30 into the Dealer's player hand 31 and then takes a card(s) 32 from the Dealers player hand 29 and then swipes the taken game card(s) 33 through the Dealer's player station card swipe slot 12 and then passes the swiped card(s) to the adjacent active player 34, in the direction as outlined in the particular game rules, or the Dealer passes the drawn card(s) 30 directly through 35 the card swipe slot 12 and then passes the swiped card(s) to the adjacent active player 34 in the direction as outlined in the particular game rules. The Dealers adjacent passed to active player then picks up 36 the Dealer passed card(s) 34 and either places the picked up card(s) 36 into 31 its player hand 29 and then takes a card(s) 32, from the player's hand 29 and then swipes the taken game card(s) 33 through the player's station card swipe slot 12 and then passes the card(s) to the adjacent active player 34, in the direction as outlined in the particular game rules, or the player passes the picked up card(s) 36 directly through 35 the card swipe slot 12 and passes the swiped card(s) to the adjacent active player 34, in the direction as outlined in the particular game rules. The passing process of picking up 36 a passed game card(s) from an adjacent active player 34 and the eventually passing a game card(s) to the next adjacent active player 34, or defined as the Passing Procedure Process, is continued until the last adjacent active player is passed game cards 34 and then eventually swipes a card(s) 33 through the card swipe slot 12. During the Passing Procedure Process when a player has the qualifying match or set of cards 37, as outlined in the particular game rules, the qualifying player may press 38 the player's press button 19.

The invention claimed is:

1. A card matching electronic board game system comprising:

a. a game playing board;

b. spaced player stations are attached to the periphery of the game board;

c. each player station having a card swipe with sound mechanism, attached one or more lights and a "player" button;

d. press buttons are attached near the center of the game board;

e. one or more speakers are attached on the game board;

f. a game controller circuit board is attached on the game board, where the game controller circuit board comprises a game controller and a game controller board memory;

g. The game controller boar memory having preloaded or downloaded sounds and/or music that can be fed into the game controller and then broadcasted through the game board speakers;

h. the player stations with card swipe with sound mechanism, attached lights and player button, lighted press buttons and speakers are connected in an electronic circuit to the game controller board;

i. the game controller configured to execute a card matching electronic board game, which entails one or more game play sessions with stacks or decks of category grouped cards; the category group card decks includes various animals, fruits and vegetables, shapes with colors, or playing cards (one through king/aces), where there are four or more matching card faces in each category deck group;

j. wherein the one or more game play sessions a begins where the dealer, or person who deals out the cards, a position of the dealer starting at one player station on the board and then moving to the left player station player to be the next dealer on the following session dealing of card hands; the dealer deals out 4, or a predetermined number, shuffled cards from the stacks or decks to each player playing at an individual player station; and once the predetermined number of cards are dealt out the "reset" or "on/off" button is pressed to notify the game controller that a new game session is starting; the game controller music and/or sounds would start playing to indicate to the players ready to play state, and each player presses the "player" button at each player's station that electrically notifies the game controller the number and location of the active player stations; the game controller "start" play button is then pressed to notify the game controller that play is beginning; the light-able press buttons would be unlit;

k. the dealer drawing an individual card from the face down game card stack and looking at the face of the drawn card; when the dealer wants the drawn card then the dealer takes the card and places the drawn card into his hand and then one card for the dealer's hand has to be discarded and the discarded card is then swiped through the dealers player station card swipe, and then the discarded swiped card is placed face down next to the closest player to the dealers left; and when the dealer does not want to place the drawn card into his hand the dealer then swipes the drawn card and then places the swiped card face down to his left to the closest player; the next player to the dealers left can the pick up the dealer placed card and place it in the players hand or the player can swipe the drawn card and then pass the drawn card to the next player to the left; and this procedure of drawing, swiping and passing continues to the last player to the left who the takes the last left player's swiped card and starts a new face down stack; and l. the card swipe slot is angled so that the swiped card's top edge is slanted outward away from the player at the card swipe player station; whereas each passed card from another player is picked up by either the player's right or left hand the player will draw the picked up card toward the player; and where some players have a tendency to get excited and not even want to look at their cards as they are passed from the right and want to just take the card and quickly passed the drawn card to the left while looking primarily to the center of the board to see if any of the light-able press buttons have been pressed; and by the player having to swipe the past and drawn card, the card swiping action pulls the attention of the player to the card swiping process plus the angle of the card in the swipe exposes the face of the card to the player, further drawing the player's attention that the drawn card may be a match to other cards in the player's hand; and m. the object of the card matching electronic game is to match or obtain a number of faced cards; as each player gets drawn cards the player is trying to get the predetermined matched number or set in the player's hand; the game controller knowing the number and location of each player, as electronically communicated to the game controller board by each active player pressing the "player" button before each session of a game, determines the number of active light-able press buttons needed in the near center of the game board; the number of active light-able press buttons is usually one less than the number of active players; the light-able press button's location and movement is determined by the location of the active players; the light-able press buttons can move to one vacant location and then to another once active play has begun; and n. when a player is too slow in passing a swiped card a sensor in the card swipe activates one or more lights that start flashing on the slow passing player's station; when the slow passing player continues to be slow a sound, possibly a buzzer, is activated by the sensor in the card swipe of the continued slow player's station further notifying the slow player who may be getting "razzed" at this time by the other players and the slow player can be disqualified from playing this game session and the slow disqualified player presses it's player station "player" button, which electronically notifies the game controller that the player has exited from the particular game session and the game controller will reduce the number of available light-able press buttons by one, and the game session can continue with the remaining players; and o. when a player gets 4 of a matched kind, or a predetermined number or sequence previously decided for the game session, the matching player then reaches out and presses one of the light-able press buttons; the pressed light-able press button(s) starts flashing; and p. the last player left who has not pressed a light-able press button is the looser of that particular session of the game with a predetermined number of session losses decides when a player is out of the game; the last person not out of the game is determined the winner of the game; and q. when a player is the first player to touch a light-able press button and does not have the 4 of a matched kind, or a predetermined matching number or sequence has been previously decided for the game session, the player is disqualified from the game session and the disqualified player presses it's player station "player" button which notifies the game controller that the player has exited and the game controller will reduce the number of available light-able press buttons by one, and the game session can continue with the remaining active players.

2. The card matching electronic board game system of claim 1 wherein when a card match is not achieved in the initial deck card passing then the last passed player's discarded deck stack is put into play, being redrawn, swiped and passed by the dealer.

3. The card matching electronic board game system of claim 1 where electronic devices can be changed or other electronic devices can be added to the electronic board game system.

4. The card matching electronic board game system of claim 1 where Mp3, DVD music or other sounds can be down loaded or added into the electronic board game system.

5. The card matching electronic board game system of claim 1 where the folded out electronic board game can be folded up in two to three sections to reduce the game board to approximately ½ size or more.

* * * * *